US010796872B1

(12) United States Patent
Huang

(10) Patent No.: US 10,796,872 B1
(45) Date of Patent: Oct. 6, 2020

(54) VEHICLE CIRCUIT BREAKER

(71) Applicant: Kuoyuh W.L. Enterprise Co., Ltd., New Taipei (TW)

(72) Inventor: Wei-Cheng Huang, New Taipei (TW)

(73) Assignee: KUOYUH W.L. ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/558,137

(22) Filed: Sep. 1, 2019

(51) Int. Cl.
*H01H 71/16* (2006.01)
*H01H 71/58* (2006.01)
*H01H 77/04* (2006.01)

(52) U.S. Cl.
CPC ..... *H01H 71/16* (2013.01); *H01H 71/58* (2013.01); *H01H 77/04* (2013.01)

(58) Field of Classification Search
CPC ..... H01H 71/16; H01H 71/58; H01H 77/04
See application file for complete search history.

(56) References Cited

U.S. PATENT DOCUMENTS 4,528,538 A * 7/1985 Andersen ..... H01H 73/26 337/2
4,573,031 A * 2/1986 Krasser ..... H01H 73/303 337/68
4,667,175 A * 5/1987 Sell ..... H01H 73/303 337/347
4,682,138 A * 7/1987 Sell ..... H01H 73/303 337/66
4,868,535 A * 9/1989 Janniere ..... H01H 71/46 337/68
5,248,954 A * 9/1993 Chiang ..... H01H 73/303 337/66
6,577,221 B1 * 6/2003 Wang ..... H01H 73/26 200/339
6,590,489 B1 * 7/2003 Ullermann ..... H01H 73/303 337/56
6,621,402 B2 * 9/2003 Huang ..... H01H 73/26 337/111
7,026,906 B2 * 4/2006 Huang ..... H01H 73/26 337/59
7,336,149 B2 * 2/2008 Ullermann ..... H01H 71/04 337/66
8,576,042 B2 * 11/2013 Ullermann ..... H01H 71/16 337/365
10,580,600 B2 * 3/2020 Ullermann ..... H01H 37/5409

* cited by examiner

*Primary Examiner* — Anatoly Vortman
(74) *Attorney, Agent, or Firm* — Leong C. Lei

(57) ABSTRACT

A vehicle circuit breaker includes a housing configured with a electrode assembly including a first electrode and second electrode; the first electrode is configured with a first conducting element and first insertion portion, and the second electrode is configured with an electrode connection portion and second insertion portion; a bimetal conducting sheet and blocking element are configured inside the housing, where the bimetal conducting sheet has a plurality of conducting concave portions for the installment of a second conducting element and the connection with the electrode connection portion, thereby carrying out a blocking action when current is abnormal and therefore making it easier for assembly.

10 Claims, 7 Drawing Sheets

VEHICLE CIRCUIT BREAKER

(a) TECHNICAL FIELD OF THE INVENTION

The present invention relates to a smaller and reusable vehicle circuit breaker.

(b) DESCRIPTION OF THE PRIOR ART

Many circuit breakers must be used in an electric vehicle. The current smaller vehicle circuit breakers mostly are fused circuit breakers; they must be replaced and discarded after used only once. If they are needed to use in large quantities, a lot of cost will be caused, and if they can be repeatedly used, they must be made larger, which makes them have no way to be installed in smaller spaces.

SUMMARY OF THE INVENTION

The main object of the present invention is to provide a vehicle circuit breaker, utilizing a bimetal conducting sheet to match a blocking element to achieve a reusable effect, and allowing the assembly to be more convenient and quicker through conducting concave portions.

To achieve the above object, the present invention proposes a vehicle circuit breaker, mainly including: a housing; an electrode assembly, configured on the housing and including a first electrode and second electrode; a first conducting element, configured on the first electrode; an electrode connection portion, configured on the second electrode; a first insertion portion, configured on the first electrode; a second insertion portion, configured on the second electrode; a bimetal conducting sheet, configured inside the housing; a plurality of conducting concave portions, configured on the bimetal conducting sheet; a second conducting element, configured on the conducting concave portion; a blocking element, movably configured inside the housing; an elastic element, configured between the blocking element and electrode assembly; and a pressing portion, configured on the blocking element.

A user may connect the electrode assembly to a vehicle by engaging the first insertion portion with second insertion portion. Upon use, one end of the bimetal conducting sheet configured with the second conducting element will be close to the electrode assembly, and the current flow will be more stable to allow the current to pass through the electrode to be used normally because both the first conducting element and second conducting element are silver contacts. When the current is abnormal, the temperature of the bimetal conducting sheet will be increased, thereby generating deformation to cause the end having the first conducting element to become warped, allowing the first conducting element to be away from the second conducting element and at the same time, the blocking element will be pushed by the elastic element to move to between the first conducting element and second conducting element, and the pressing portion will be pushed out of the housing so that the first conducting element and second conducting element will not be in contact with each other because of the blocking of the blocking element even if the bimetal conducting sheet returns to its original shape due to temperature drop. When the present invention wants to be used again, the pressing portion can be pressed down to cause the blocking element to be separated from between the first conducting element and second conducting element, and the bimetal conducting sheet will then drive the first conducting element to be in contact with the second conducting element to continue conducting the electrode assembly.

Since the first conducting element is installed on the conducting concave portion, and the electrode connection portion is also in connection with the bimetal conducting sheet through the conducting concave portion so that the assembly is more convenient and quicker. In addition, the depression depth of the conducting concave portion is set between 0.15 and 0.4 mm so that the present invention can be used in a smaller housing and so has a small volume.

DETAILED DESCRIPTION OF THE PREFERRED EMBODIMENTS

Figure 1:
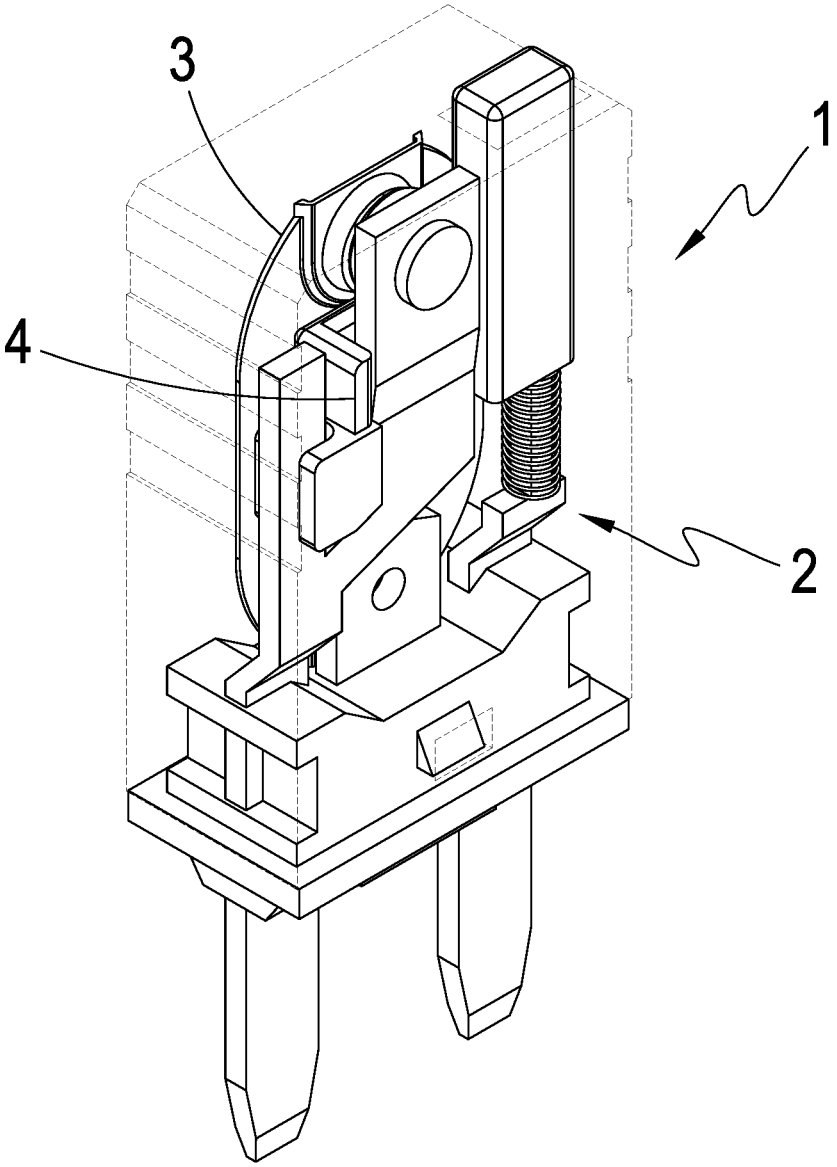
FIG. 1 is a perspective view of the present invention, where a housing is shown in dot lines.
Figure 2:
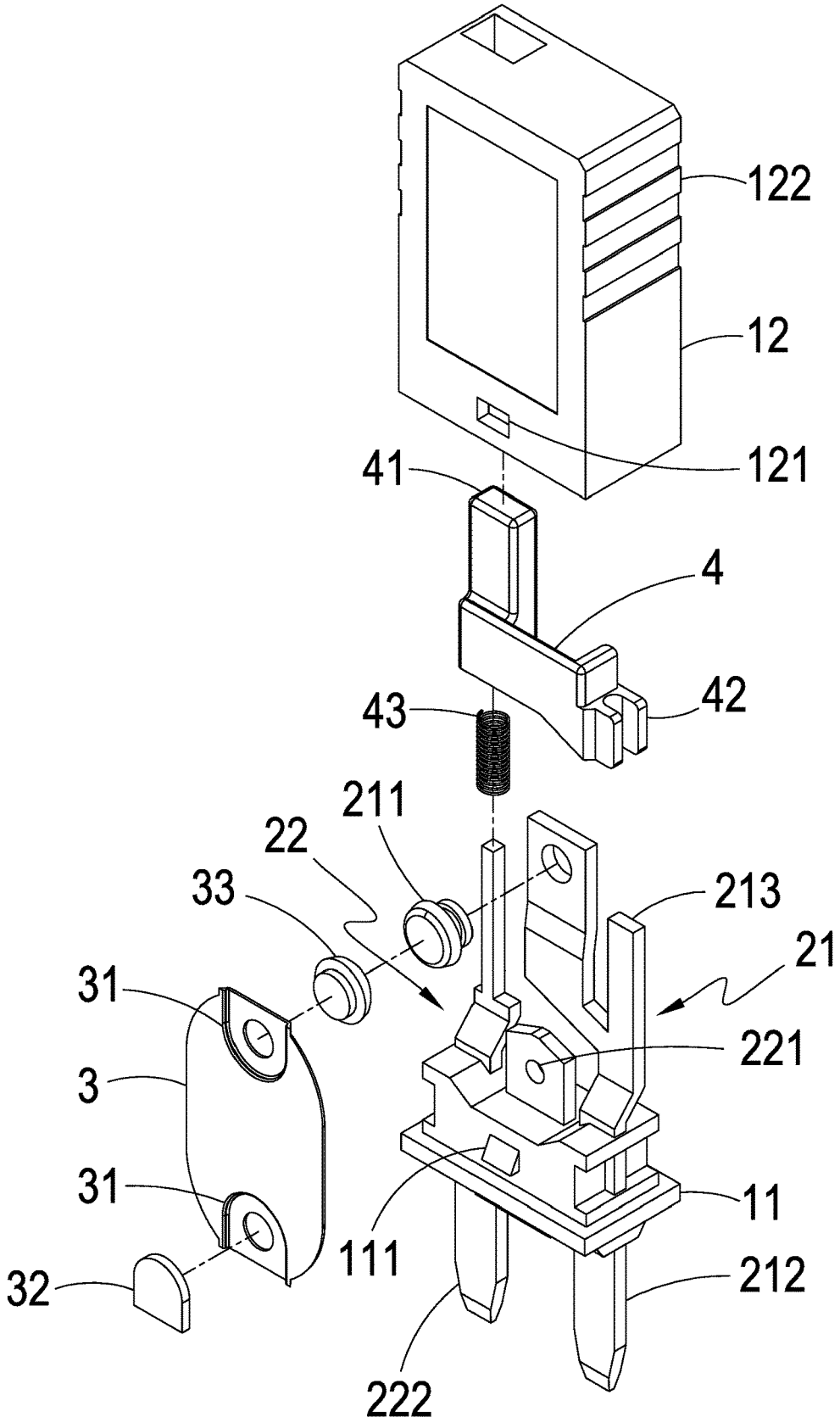
FIG. 2 is an exploded view of the present invention.
Figure 3:
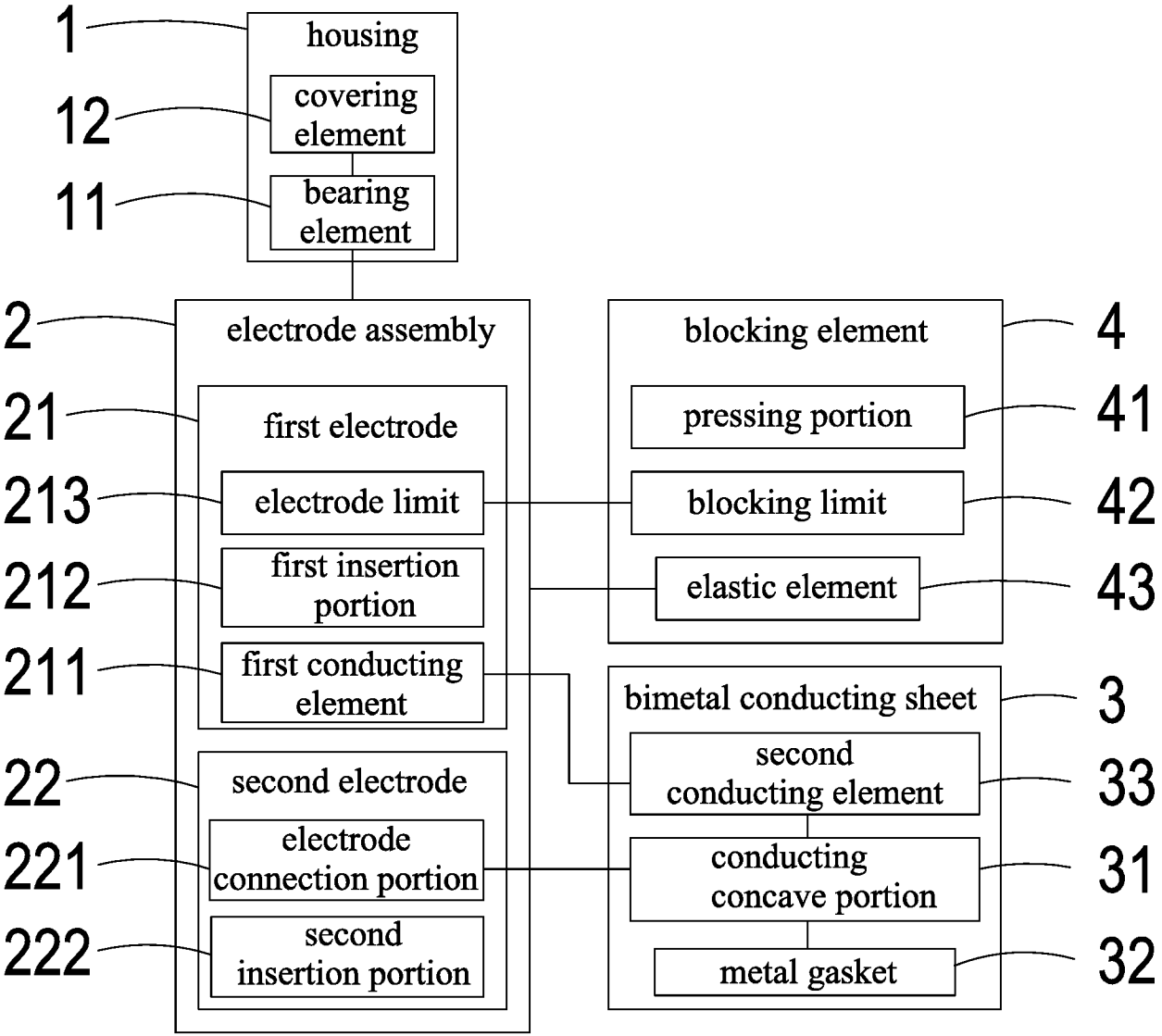
FIG. 3 is a structural block diagram of the present invention.
Figure 4:
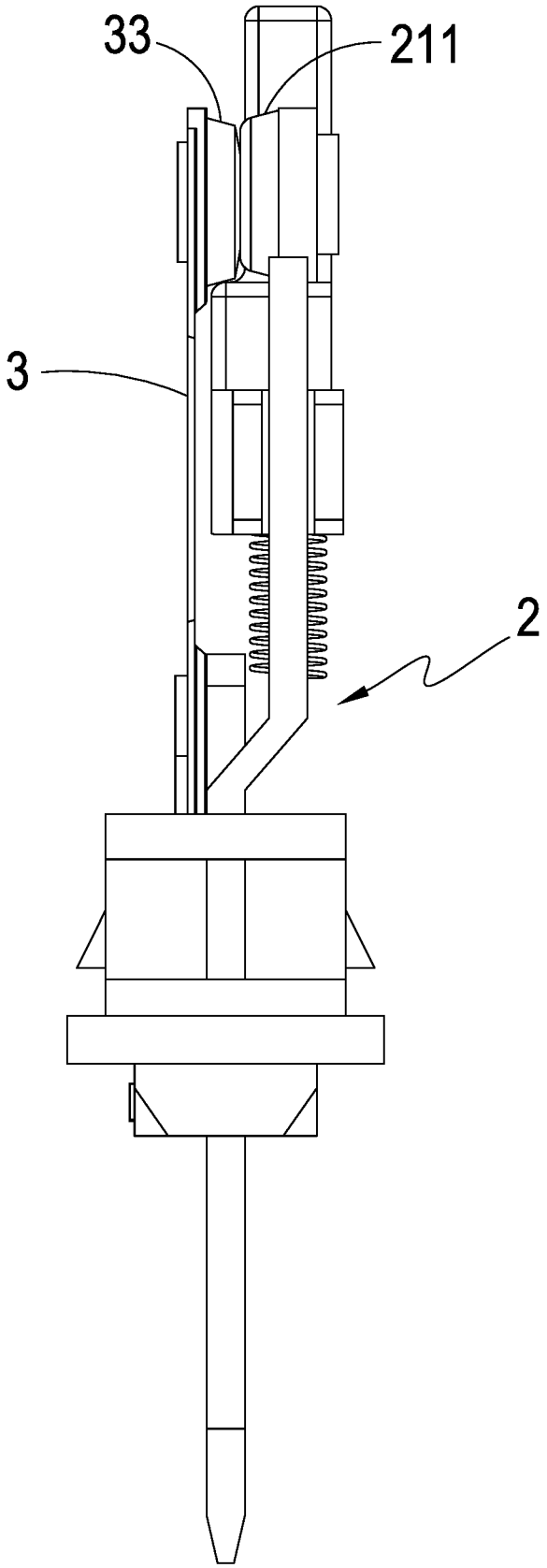
FIG. 4 is a schematic view of the present invention in an electric conduction state.
Figure 5:
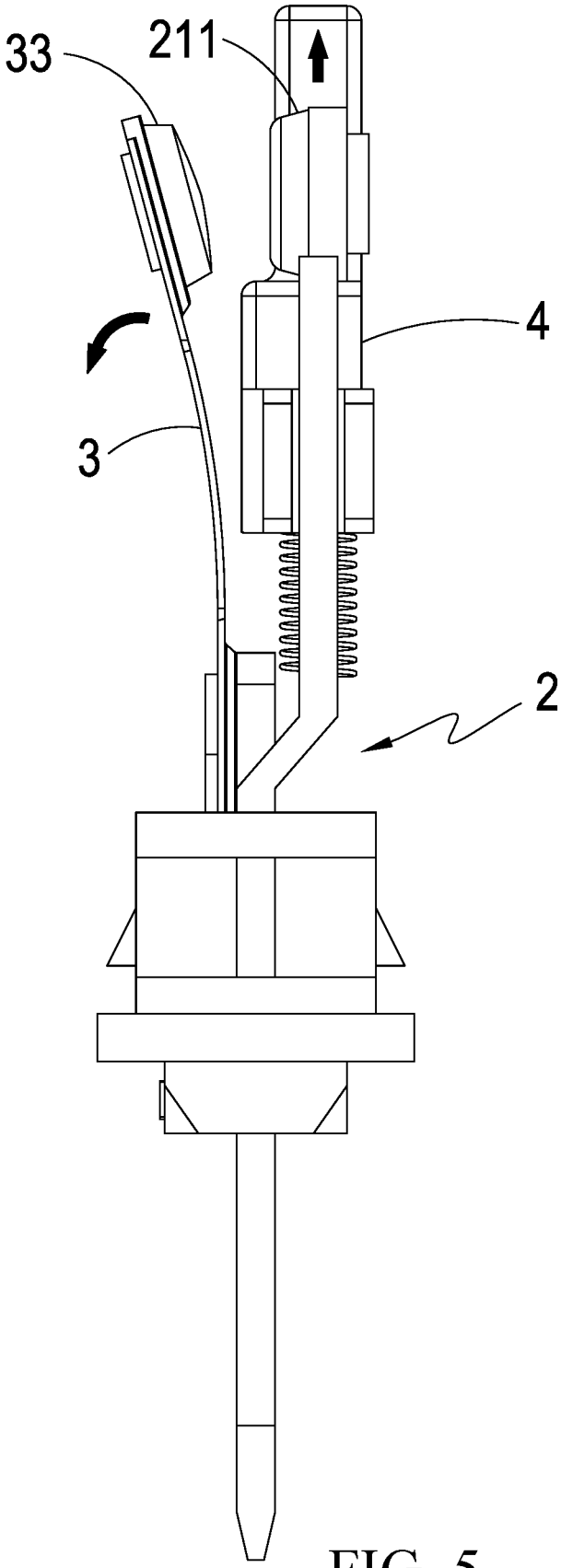
FIG. 5 is a schematic view of the present invention in an abnormal stat.
Figure 6:
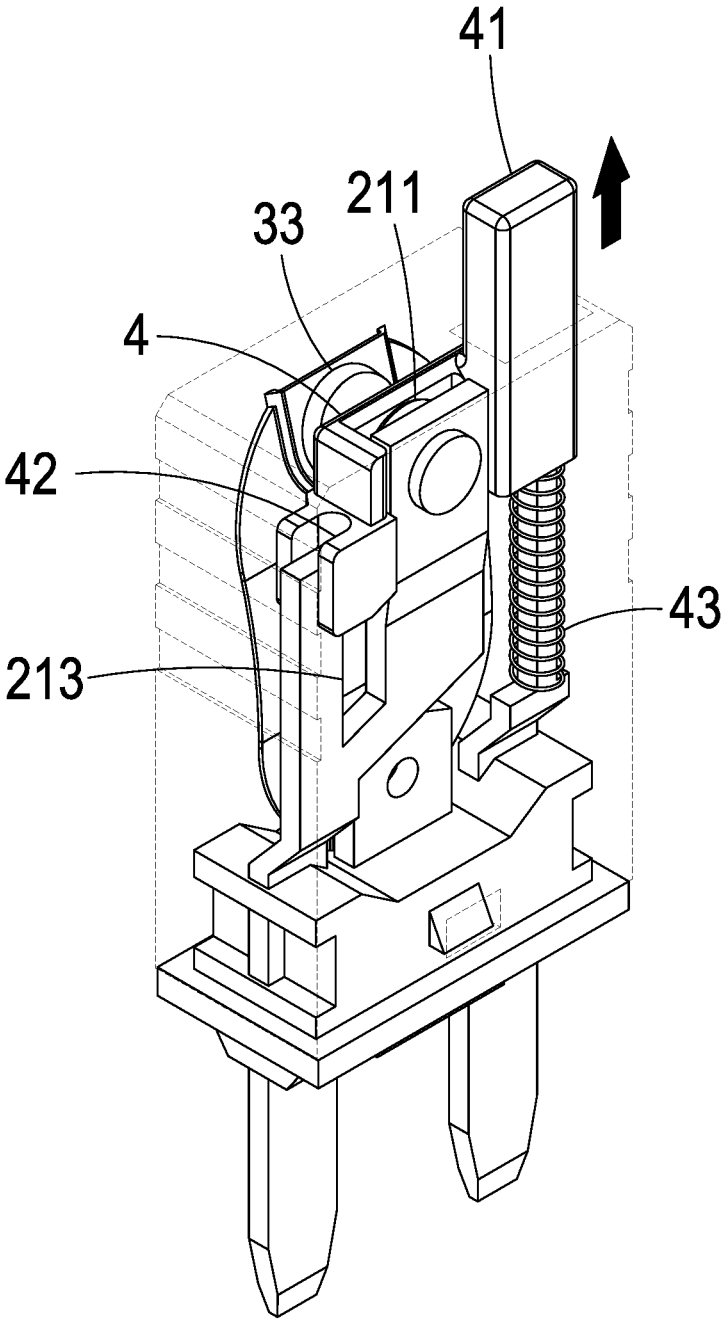
FIG. 6 is a perspective view of the present invention in a blocking state.
Figure 7:
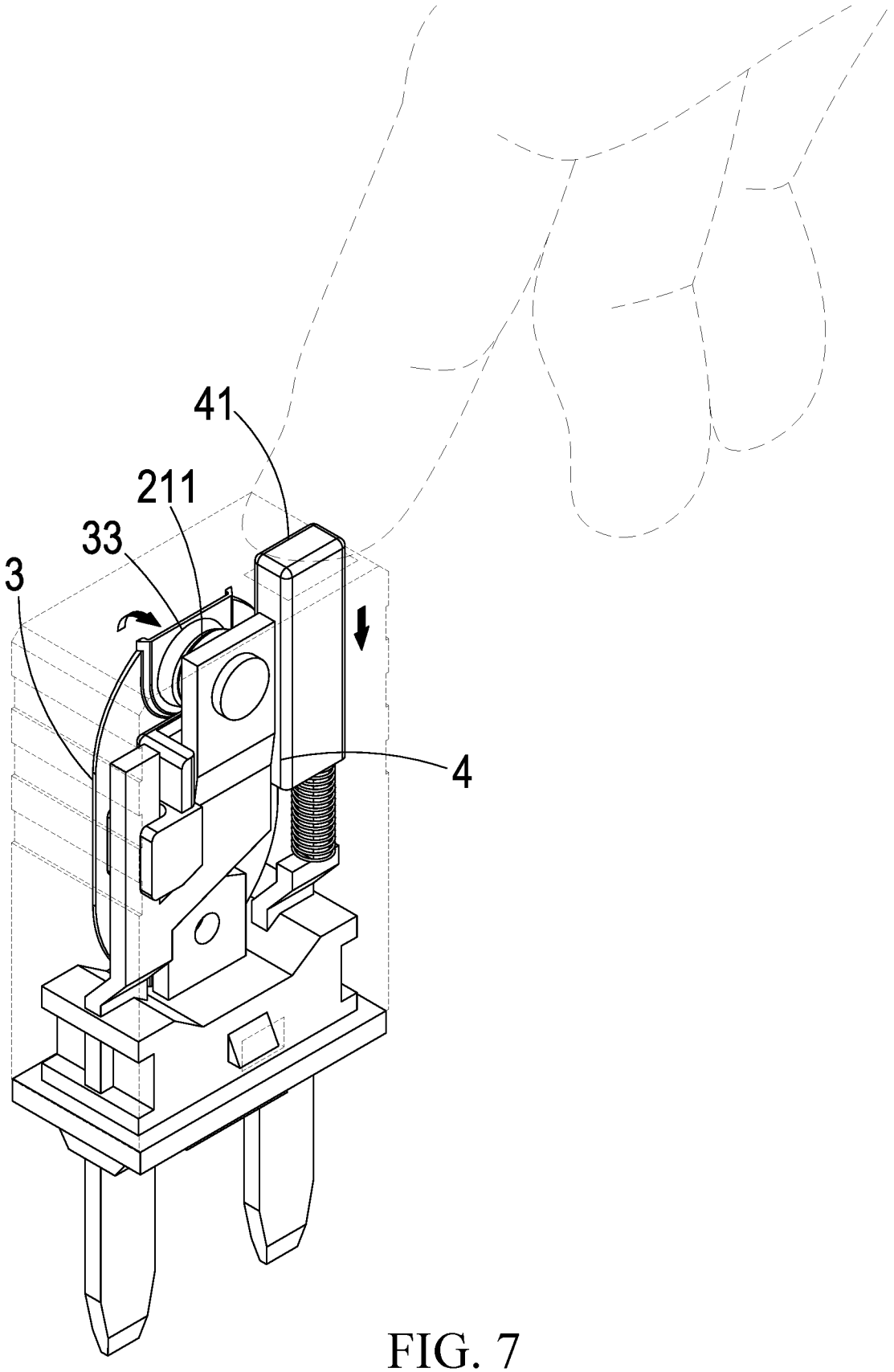
FIG. 7 is a perspective view of the present invention, where a pressing portion is pressed down.

Referring to FIGS. 1 to 3, a vehicle circuit breaker includes a housing 1, a plurality of slip stops 122, an electrode assembly 2, a first conducting element 211, an electrode connection portion 221, a first insertion portion 212, a second insertion portion 222, a bimetal conducting sheet 3, a plurality of conducting concave portions 31, a metal gasket 32, a second conducting element 33, a blocking element 4, an elastic element 43, a blocking limit 42 and a electrode limit 42.

The housing 1 has a bearing element 11 and a covering element 12 covered on the bearing element 11, where the bearing element 11 has a plurality of first connection portions 111, and the covering element 12 has a plurality of second connection portions 121 corresponding to the plurality of first connection portions 111, allowing the covering element 12 to be fixed to the bearing elements 11 by engaging the first connection portions 111 with the corresponding second connection portions 121. In a preferred embodiment, both the bearing element 11 and covering element 12 respectively are a plastic shell, and each first connection portion 111 is an engagement convex portion and each second connection portion 121 is a through hole adapted to be in engagement with the corresponding first connection portion 111, but the number of first connection portions 111 and the one of the second connection portions 121 are not limited in the present invention.

The plurality of slip stops 122 are configured on the covering element 12. In a preferred embodiment, the slip stops 122 are formed on a groove of the covering element 12.

The electrode assembly 2 is configured in the housing 1 and includes a first electrode 21 configured on the bearing element 11 and a second electrode 22 configured on the bearing element 11 and positioned at one side of the first electrode 21.

The conducting element 211 is configured on the first electrode 21 and riveted to a silver contact of the first electrode 21.

The electrode connection portion 221 is configured on the second electrode 22 and positioned in the housing 1.

The first insertion portion 212 is configured on the first electrode 21 and positioned outside the housing 1.

The second insertion portion 222 is configured on the second electrode 22 and also positioned outside the housing 1, and the first insertion portion 212 and second insertion portion 222 can be correspondingly plugged into a required vehicle body so as to allow the electrode assembly 2 to be in electric connection with a circuit inside the vehicle body.

The bimetal conducting sheet 3 is configured inside the housing 1.

The plurality of conducting concave portions 31 are configured on the bimetal conducting sheet 3 and positioned on the respective ends of the bimetal conducting sheet 3, where the depth of the depression of the conducing concave portion 31 is between 0.15 and 0.4 mm. Furthermore, the bimetal conducting sheet 3 is in connection with the electrode connection portion 221 through one of the conducting concave portions 31; the connection way is spot weld connection or rivet connection; the spot weld connection is exemplified in a preferred embodiment.

The metal gasket 32 is configured on the conducting concave portion 31 and on one side of the conducting concave portion 31 and electrode connection portion 221 because the spot weld connection is carried out in the embodiment, allowing the spot weld effect to be more stable.

The second conducting element 33 is configured on the conducting concave portion 31 and adapted to be in corresponding contact with the first conducting element 211.

The blocking element 4 is movably configured inside the housing 1 and has a pressing portion 42 passed out of the housing 1.

The elastic element 43 is respectively connected with the electrode assembly 2 and blocking element 4, allowing the blocking element 4 to be moved to between the first conducting element 211 and second conducting element 33 through the elastic force of the elastic element 43.

The blocking limit 42 is formed on the blocking element 4, allowing the sliding of the blocking element 4 to be limited on the electrode assembly 2 through the blocking limit 42.

The electrode limit 213 is formed on the first electrode 21 and positioned correspondingly to the blocking limit 42. In a preferred embodiment, the blocking limit 42 is a groove formed on the blocking element 4, and the electrode limit 213 is a rod adapted to limit the sliding of the groove.

Referring to FIGS. 1 to 7, the bimetal conducting sheet 3 is a metal sheet made by combining two metals with different coefficients of thermal expansion together so that it usually is a bent metal sheet with a curved surface, which makes the assembly often troublesome. But, the present invention is configured with the two conducting concave portions 31 on the bimetal conducting sheet 3, the assembly can then be carried out through the planes of the conducting concave portions 31 to increase assembly convenience. In the embodiment, the second conducting element 33 may be riveted in one of the conducting concave portions 31, and the metal gasket 32 is then positioned in another conducting concave portion 31 to match the spot weld effect, allowing the bimetal conducting sheet to be assembled with and connected to the electrode connection portion 221 more completely. In addition, since the present invention is a smaller circuit breaker in which the thickness of the bimetal conducting sheet 3 is approximately 0.8 mm and the space inside the housing 1 is only approximately 6.6 mm, so that the depression depth of the conducting concave portion 31 will be set between 0.15 and 0.4 mm, and the metal conducting sheet 3 can then have a swinging space.

With the above assembly method, the bimetal conducting sheet 3 can then be fixed to the electrode assembly 2, and the bearing element 11 and covering element 12 are further formed into the housing 1 by engaging the first connection portions 111 with the respective second connection portions 121. Thereafter, the slip stop 22 is held to plug the first insertion portion 212 and second insertion portion 222 into a vehicle body to allow the electrode assembly 2 to be in electric connection with a circuit (a circuit type is not limited, the present invention can be used on any circuit that requires a circuit breaker, such as a power box) inside the vehicle body. On normal use, one end of the bimetal conducting sheet 3 having the second conducting element 33 will be in contact with the first electrode 21, thereby allowing the first conducting element 211 to be in contact with the second conducting element 33 to enable the first electrode 21 to be in electric connection with the second electrode 22 and thus enable the circuit in the vehicle body to be operated normally. It is particularly mentioned here that the first conducting element 211 and second conducting element 33 are respectively made of a silver contact so as to make current flow more smoothly by virtue of the superior conductivity of silver because the present invention may be used in a circuit of larger current.

When the circuit is abnormal and the current flow is increased, the bimetal conducting sheet 3 will be caused to be increased in temperature. Since the bimetal conducting sheet 3 is made of two metal sheets with a different coefficient of thermal expansion, the bimetal conducting sheet 3 will be bent toward one side of the lower coefficient of thermal expansion when the temperature is increased so that the first conducting element 211 will be caused to be away from the second conducting element 33, allowing the circuit to be broken. Furthermore, in a conduction state, the blocking element 4 will also be blocked by the first conducting element 211 even if it is pushed by the elastic element 43 and will not be moved to between the first conducting element 211 and second conducting element 33, But, when the first conducting element 211 is away from the second conducting element 33, the blocking element 4 will be driven by the elastic element 43 to move to between the first conducting element 211 and second conducting element 33; the movement of the blocking element 4 is allowed to be more accurate by matching the blocking limit with electrode limit 213. Therefore, when the bimetal conducting sheet 3 drives the first conducting 211 to move toward the second conducting element 33 after the temperature of the bimetal conducting sheet 3 is decreased, but this movement will still be stopped by the blocking element 4, thereby increasing use safety. When a user confirms that the circuit is not abnormal and needs to continue to use it, they may push the pressing portion 41 to drive the blocking element 4 to be away from between the first conducting element 211 and second conducting element 33. meanwhile, the bimetal conducting sheet 3 will then drive the first conducting element 211 to be in contact with the second conducting element 33 again, thereby achieving reusability.

I claim:

1. A vehicle circuit breaker, comprising:

a housing;

an electrode assembly, disposed in said housing and comprising a first electrode configured on said housing and a second electrode configured on said housing, said second electrode positioned at one side of said first electrode;

a first conducting element, configured on said first electrode, positioned inside said housing, and being a silver contact;

an electrode connection portion, configured on said second electrode and positioned inside said housing;

a first insertion portion, configured on said first electrode and positioned outside said housing;

a second insertion portion, configured on said second electrode and positioned outside said housing;

a bimetal conducting sheet, configured inside said housing and positioned correspondingly to said electrode assembly;

a plurality of conducting concave portions, configured on two respective sides of said bimetal conducting sheet, the depression depth of said conducting concave portions being 0.15 to 0.4 mm, and said bimetal conducting sheet is connected to said electrode connection portion through one of said conducting concave portions;

a second conducting element, configured on another of said conducting concave portions and positioned correspondingly to said first conducting element, thereby allowing said second conducting element to contact and electrically connect with said first conducting element, and said second conducting element being a silver contact;

a blocking element, movably configured inside said housing and positioned between said electrode assembly and said bimetal conducting sheet;

an elastic element, said blocking element and electrode assembly respectively connected to two ends thereof, and said blocking element adapted to move to between said first conducting element and second conducting element through the elastic force of said elastic element; and a pressing portion, configured on said blocking element and passed out of said housing.

2. The breaker according to claim 1, wherein said housing has a bearing element and a covering element covered on said bearing element, and said electrode assembly is configured on said bearing element.

3. The breaker according to claim 2, wherein at least one first connection portion is configured on said bearing element.

4. The breaker according to claim 3, wherein at least one second connection portion correspondingly connected to said first connection portion is configured on said covering element.

5. The breaker according to claim 1, wherein said blocking element has a blocking limit adapted to allow said blocking element to be slid and limited on said electrode assembly through said blocking limit.

6. The breaker according to claim 5, wherein said electrode assembly has an electrode limit adapted to allow said blocking limit to be slid and limited thereon.

7. The breaker according to claim 1, wherein said electrode connection portion is connected to said conducting concave portion by means of spot welding or riveting.

8. The breaker according to claim 7, wherein said conducting concave portion has a metal gasket adapted to facilitate said spot weld connection of said electrode connection portion with said conducting concave portion.

9. The breaker according to claim 1, wherein said bimetal conducting sheet is deformed through temperature change to drive said second conducting element to be in contact with or separated from said first conducting element.

10. The breaker according to claim 1, wherein said housing is configured with at least one slip skip.

* * * * *